US008632219B2

(12) United States Patent
Holten

(10) Patent No.: US 8,632,219 B2
(45) Date of Patent: Jan. 21, 2014

(54) LUMINAIRE HAVING A TUBULAR HOUSING

(75) Inventor: Petrus Adrianus Josephus Holten, Aalten (NL)

(73) Assignee: Koninklijke Philips N.V., Eindhoven (NL)

( * ) Notice: Subject to any disclaimer, the term of this patent is extended or adjusted under 35 U.S.C. 154(b) by 1 day.

(21) Appl. No.: 13/500,661

(22) PCT Filed: Oct. 6, 2010

(86) PCT No.: PCT/IB2010/054516

§ 371 (c)(1), (2), (4) Date: Apr. 6, 2012

(87) PCT Pub. No.: WO2011/045711

PCT Pub. Date: Apr. 21, 2011

(65) Prior Publication Data

US 2012/0201032 A1 Aug. 9, 2012

(30) Foreign Application Priority Data

Oct. 12, 2009 (EP) ..... 09172752

(51) Int. Cl.
*F21V 9/00* (2006.01)

(52) U.S. Cl.
USPC ..... 362/293; 362/291

(58) Field of Classification Search
USPC ..... 362/296
See application file for complete search history.

(56) References Cited

U.S. PATENT DOCUMENTS

| | | | | |
|---|---|---|---|---|
| 3,790,774 | A | 2/1974 | Miller et al. | |
| 4,753,603 | A * | 6/1988 | Hafstad | 439/226 |
| 5,381,321 | A | 1/1995 | Fearing, Jr. et al. | |
| 6,624,554 | B2 * | 9/2003 | Holzer | 313/318.01 |
| 2003/0002280 | A1 | 1/2003 | Paravantsos | |
| 2003/0081419 | A1 | 5/2003 | Jacob et al. | |

FOREIGN PATENT DOCUMENTS

| | | | |
|---|---|---|---|
| DE | 9013783 | U1 | 12/1990 |
| DE | 29806967 | U1 | 7/1998 |
| EP | 0080703 | A2 | 6/1983 |
| WO | 8605857 | | 10/1986 |

* cited by examiner

*Primary Examiner* — Mary Ellen Bowman
(74) *Attorney, Agent, or Firm* — Mark L. Beloborodov

(57) ABSTRACT

A luminaire (1) comprising a one-piece, transparent, tubular housing (3) with an annular wall (5). Said housing comprising an elongated light emission window (9), a reflector area (11) inside the housing and adjacent the light emission window, an electrical contacting support (13) inside the housing and remote from the light emission window, and two open ends. Elongate reflectors (21) extend towards the electrical support in a direction transverse to the axis. Two end parts (53) close the tubular housing (3) as each end part is provided at a respective open end and is electrically connected to a respective electrical contact. The lamp (17), together with the electrical contacts, can be replaced in the housing without the necessity to remove the reflectors as well.

11 Claims, 3 Drawing Sheets

LUMINAIRE HAVING A TUBULAR HOUSING

FIELD OF THE INVENTION

The invention relates to a luminaire comprising a one-piece, transparent, tubular housing with an annular wall. The invention further relates to a one-piece, transparent, tubular housing, and to end parts and a louver therefor.

BACKGROUND OF THE INVENTION

Such a luminaire is known from U.S. Pat. No. 5,381,321. The known luminaire is designed to withstand hazardous atmospheres and to be explosion proof. The one-piece housing provides a relatively reliable closed housing and also avoids the use of relatively complex sealing steps to seal the housing with an elongated cover, as is well known from for example luminaires used for road illumination. In the known luminaire the housing is used as a protection for a light source, in this case a fluorescent lamp, which is to be accommodated in electrical contacting supports inside the housing. A rigid reflector optic mechanically connects the electrical contacting supports. The reflector optic and the electrical contacting supports, accommodating the fluorescent lamp, are held in a light carriage and together form a complete unit. The fluorescent lamp is only replaceable after removal of the complete unit from the housing. The known luminaire has various disadvantages. For example, replacement of the fluorescent tube is relatively cumbersome as not only the lamp itself, accommodated in the electrical contacting supports, but also the reflector optic has to be taken out and reinserted, involving the risk of a polluted reflector surface, for example by fingerprints, and/or damage to the reflector optic and/or a wrong position of the unit after reinsertion. Another disadvantage is that the reflector optic has to be rigid as it is the mechanical connection between the electrical contact supports and thus must retain its shape and be able to withstand the replacement operations. To render the reflector optic sufficiently mechanically robust, the reflector optic requires relatively much of the relatively expensive reflector material.

SUMMARY OF THE INVENTION

It is an object of the invention to provide a luminaire of the type as described in the opening paragraph in which at least one of the disadvantages is counteracted. To achieve this the luminaire has the following features:

- the annular wall of the housing is around a luminaire axis, said housing comprising:
  - a light emission window extending along the luminaire axis,
  - a reflector area adjacent the light emission window,
  - at least one electrical contacting support provided as a profiled structure part of an inner side of the annular wall, inside the housing and remote from the light emission window,
  - two open ends in angled position with respect to the luminaire axis;
- electrical contacts for accommodating at least one electrical lamp, said electrical contacts being removably held by the at least one electrical contacting support;
- a first and a second end part, each end part being provided at a respective open end and at least the first end part being electrically connected to an electrical contact;
- reflective means provided in the reflector area.

The reflective means could for example be an optic foil, a sprayed reflective coating, a (semi-) translucent strip, metallic or synthetic reflectors. The one-piece housing is obtainable, for example, via an injection molding process or via an extrusion process. In the latter case, and when the housing is provided with at least one reflector support, the reflector support and the at least one electrical contacting support are embodied as rib profiles extending over substantially the whole length of the housing along the luminaire axis. In the luminaire, the reflectors on the one hand and the electrical contacts and the light source on the other hand are independently exchangeable inside the housing, thus making replacement of the fluorescent tube relatively simple. Optimization of the desired light distribution to be obtained by the luminaire is relatively simple as reflector versions can be simply provided in the reflector area by sliding the reflector(s) into the rib-profiled reflector support(s). Thus, a high degree of beam control, a high degree of flexibility with regard to serving different lighting applications, for example, parking garage illumination, shop lighting, clean room lighting, is obtained. In an embodiment of the luminaire at least two reflectors are each held by a respective reflector support and extend from adjacent the light emission towards the at least one electrical support in a direction transverse to the axis. As each reflector is supported over its full length by the reflector supports, the requirement for the reflectors to be rigid is taken away, enabling the reflectors to be made thinner, thus saving material and costs. The light source can, for example, be a low pressure discharge lamp, for example a low pressure sodium lamp (SOX) or a (compact) fluorescent lamp (TL, PL, SL), one or more arrays of LEDs, OLEDs, or a high pressure discharge lamp for example a high pressure sodium discharge lamp (SON) or high pressure mercury discharge lamp (HP, MHN, MSR). The tubular shaped housing can have various shapes in cross section, for example, it can have a circular, elliptical, triangular, square, rectangular, trapezoidal, or hexagonal cross section, whether rounded or not. The cross section in the reflector area could even be made to comprise one or two branches of parts of a parabola, an arc of an ellipse, a part of a circle etc., which parts of the tubular housing could then be provided internally with a reflective coating, for example via spraying or with an adhesive reflective foil. The reflector supports are integral with the annular wall of the housing and are provided at an inner side of said annular wall. Said reflector supports are embodied as a profiled structure, for example they could be embodied as local protrusions extending from the annular wall or as a protruding continuous rib, or for example, as a continuous/local recess in the inner side of the wall. Thus, the wall of the tubular housing not only acts as protection for the light source but simultaneously acts as elongated reflector(s) for the lamp. Thus, a relatively cheap and robust luminaire is obtained. Other common reflector cross-sectional shapes of the tubular housing are envisaged. End parts, adapted to the cross-sectional shape of the housing are provided in the open ends for sealing the inside of the luminaire, thus rendering the luminaire waterproof, explosion proof and/or dustproof. The first and second end part match with and electrically connect to a respective electrical contact of the electrical contact supports in a sealed manner and enable electrical contacting of the luminaire on the outside of the luminaire. Alternatively it is possible that the electrical contacting occurs via the first end part only, which, for example, is advantageously usable in vertical applications with the luminaire suspended from a ceiling or standing on a floor. Electrically contacting the electrical contact remote from the first end can, for example, be done via a metallic reflector part which is mounted, in a further electrically isolated way, in the electrically non-conductive housing.

An embodiment of the luminaire is characterized in that the at least one reflector is held in between a respective reflector support and a respective further reflector support neighboring the at least one electrical contacting support. The luminaire may have one, two or even more reflectors, each with a respective reflector support and a further reflector support. The at least one reflector thus is firmly held on both sides substantially over its full length. The advantage of a further savings in material and costs is thus obtained as the reflector can be made still thinner as it neither needs to be rigid in a direction along the luminaire axis nor in a direction transverse to the luminaire axis.

In some applications it is required to illuminate the ceiling from which the luminaire is suspended. This is attainable in the known luminaire by providing holes in the reflector. However, this has the disadvantage that it does not only negatively influence the optical properties of the luminaire but also requires additional process steps, thus rendering the manufacturing of the luminaire relatively complex and expensive. To counteract this disadvantage, another embodiment of the luminaire is characterized in that an opening is present between the at least one electrical contacting support and a respective reflector and/or a respective further reflector support. As the housing is made of transparent material the opening acts as an optic gap, enabling light to pass through said opening and subsequently through the wall to the exterior and hence provide indirect lighting. Illumination of the ceiling thus is attained in a relatively simple manner. The size of the opening and hence the amount of light for the indirect lighting can easily be set, and can be further controlled by selection of the type of reflector or type and amount of coating on the wall controlling the amount of light that is reflected towards said openings.

Still another embodiment of the luminaire is characterized in that the reflectors are made in one piece with the housing. Said reflectors are obtained in a relatively simple and cheap manner in that they are manufactured simultaneously with the housing in an extrusion process. In dependence on the desired beam characteristics as obtained from the luminaire, the desired properties of the reflectors can be adjusted by adjusting the shape of the reflector area, and/or providing the reflectors or reflector area, for example, at least locally with a reflective coating or with a semi-translucent, reflective coating, for example an adhesive or sprayed white polymer strip. Alternatively, the white polymer strip is embodied as a separate part which is slideable into the housing so as to at least partially cover the reflector. The light beam is then generated through the reflection component of the translucent reflector, while the transmission component of the translucent reflector realizes a moderate brightness at the sides of the luminaire, for example as desired for guidance. Such guidance is highly appreciated in, for example, parking garages, or in shops for merchandise recognition. In particular this is appreciated in the case that the translucent reflector has a transmission of only a few percent, thus giving the luminaire a glowing appearance during operation.

A still further embodiment of the luminaire is characterized in that the reflectors and/or the light emission window have a rippled profile extending along the luminaire axis. Such a rippled profile can be manufactured simultaneously with the housing in a molding/extrusion process. An example of a rippled profile is a Fresnel lens structure. The optical properties of Fresnel-like profiles are well investigated and readily available. Thus, desired beam patterns for the luminaire can be obtained relatively easily via specifically designed/selected rippled profiles.

Still another embodiment of the luminaire is characterized in that the light emission window is provided with an optic foil. The optic foil could be fixed to the light emission window either inside or outside the housing or, alternatively, could be embodied as a separate, loose component that is slid into the housing. The optical properties obtained from the luminaire thus can relatively easily be adjusted as desired. The optic foil can provide many different features to the luminaire; preferably the optic foil has at least one of the following features, chosen from the group consisting of: lens structure, color, diffusion/reflection pattern, UV-filter. These features are appropriate for the most common applications of luminaires, for example, in shops to enhance colors of food to make it more attractive to customers, or protection of food against UV-induced flavor changes. Counteracting glare is enabled, for example, by providing an optic foil with a reflection pattern.

A still further embodiment of the luminaire is characterized in that it comprises a louver comprising the at least two reflectors connected to each other via cross lamellae having an outer edge adjacent the light emission window. The cross lamellae counteract glare as they shield the light source from direct view at undesired viewing angles; it is thus made possible to fulfill illumination criteria of workplace environment conditions with respect to glare. The louver can be slid into the housing; to this end the louvers are provided with slots enabling the louver to slide over the axially extending rib-profiled reflector supports.

The invention further relates to various elements of the luminaire, in particular the housing, end part and louver. Each element as such comprises all its element characteristics as defined before in the description of the luminaire.

BRIEF DESCRIPTION OF THE DRAWINGS

These and other aspects, features and advantages of the invention are apparent from and will be elucidated by means of the embodiments described hereinafter, with reference to the schematic drawings, in which.

DETAILED DESCRIPTION OF EMBODIMENTS

Figure 1:
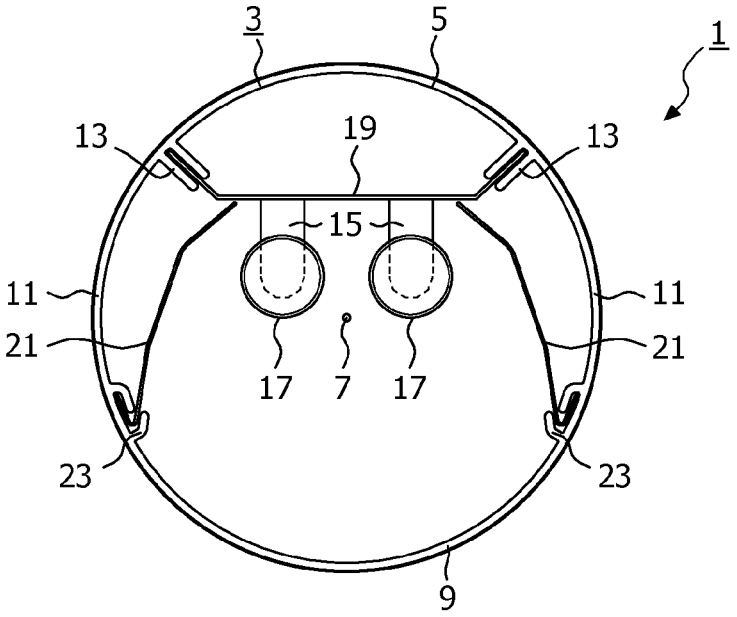
FIG. 1 is a cross section of a first embodiment of the luminaire of the invention.

In FIG. 1, a luminaire 1 according to the invention is shown. The luminaire has a one-piece, transparent, tubular housing 3 with a circular annular wall 5 around a luminaire axis 7. Said housing comprises a light emission window 9 extending along the luminaire axis, a reflector area 11 inside the housing and adjacent the light emission window, two rib-shaped electrical contacting supports 13 inside the housing and remote from the light emission window, and two open ends (not shown) in angled position with respect to the luminaire axis. The housing further comprises electrical contacts 15 for accommodating two low pressure mercury discharge fluorescent lamps 17, said electrical contacts being mounted on a gear tray 19 which is held by the two electrical contacting supports so as to enable the gear tray to be slid into and removed from the housing. Reflective means 21, in the Figure two separate white-coated, metallic reflectors, each shaped like a part of a kinked arc of an ellipse, are provided in the reflector area. Each reflector is slid into the housing and subsequently removably held by a respective rib-shaped reflector support 23. The reflector supports are located inside the housing and adjacent the light emission window. The housing is made of extruded, colorless, transparent polyethylene.

Figure 2:
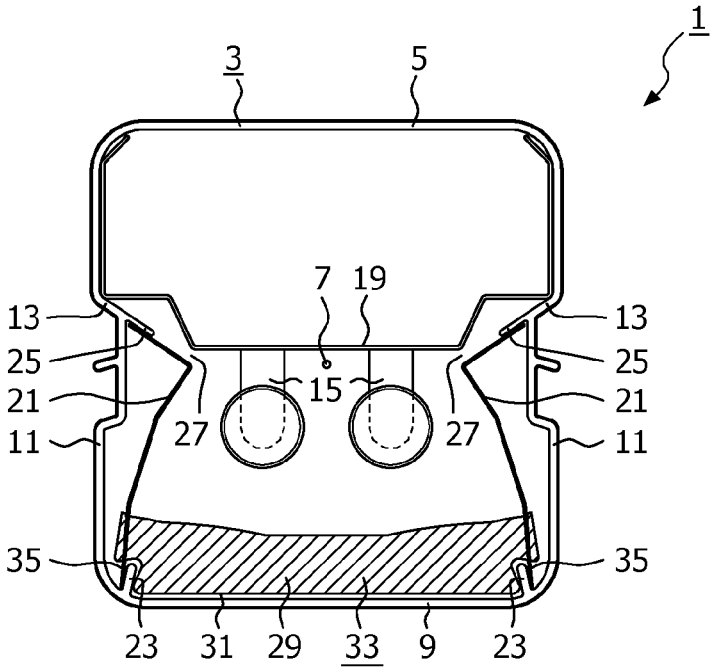
FIG. 2 is a cross section of a second embodiment of the luminaire of the invention.

In FIG. 2, a cross section of a second embodiment of the luminaire 1 of the invention is shown. The tubular housing 3 has, in cross section, a square-like annular wall 5 around axis 7. Two aluminum reflectors 21, each shaped according to the branch of a parabola, are provided in a reflector area 11 and are each mounted in a respective reflector support 23 and a further reflector support 25. As the reflectors are each supported by both the (rib-shaped) reflector support and the (rib-shaped) further reflector support, only little mechanical strength is required for the reflectors, which thus can be made of relatively thin plate material, thus saving costs. The further reflector supports neighbor the electrical contacting supports 13 which carry the gear tray 19 on which the electrical contacts 15 are mounted. An opening 27 is present between the electrical contacting support and the neighboring further reflector support. As the housing is made of transparent material, in this Figure extruded polycarbonate, the opening acts as an optic gap enabling light to pass through said opening and subsequently through the wall to the exterior and hence to provide indirect lighting during operation. Illumination of, for example, the ceiling thus is attained in a relatively simple manner. To further control the light distribution, in particular in relation to glare, both reflectors 21 are connected to each other via cross lamellae 29. Each lamella has a straight outer edge 31 adjacent the light emission window 9, the lamellae and the two reflectors together form a complete louver 33 which is slidable into the tubular housing over the reflector supports and further reflector supports and removably held thereby. Depending on the desired light beam characteristics and glare demands, the shape of the cross lamellae is selected, for example, such that the lamellae have an outer edge which is concave, or alternatively, convex towards the light emission window. Also, viewed in cross section along the luminaire axis, the lamellae could have a two-dimensional or three-dimensional shape, for example a (curved/straight) V-shape. The lamellae are provided with special slots 35 to enable the louver to slide over the reflector supports 23.

Figure 3:
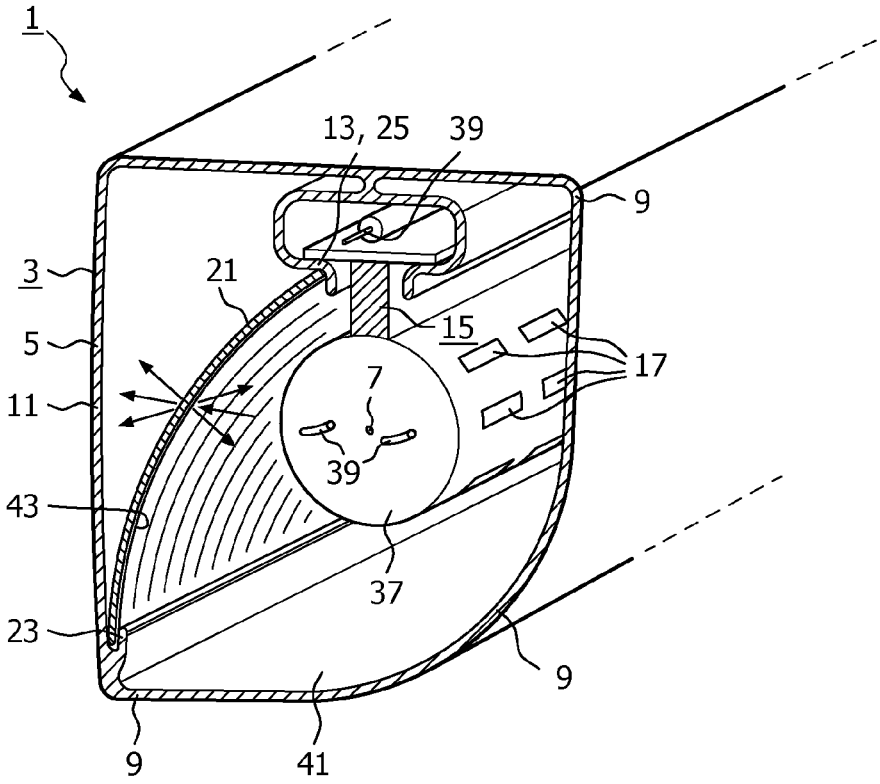
FIG. 3 is a perspective view of a third embodiment of the luminaire of the invention.

In FIG. 3, a perspective view of a third embodiment of the luminaire 1 of the invention is shown. In this embodiment there is only one electrical contacting support 13 holding the electrical contact 15 which simultaneously acts as a further reflector support 25 for only one reflector 21 in the reflector area 11, the reflector being shaped like a part of a circle in cross section. Further, the reflector is held in a rib-shaped reflector support 23 adjacent the light emission window 9. The light emission window extends over a relatively large part of the circumference of the annular wall 5 of the transparent polyethylene housing 3, i.e. from the reflector support 23 practically up to the electrical contacting support 13. The reflector is provided with a separate, slideable, reflective but semi-translucent, white polymer strip 43 enabling diffused light from the light source 17 to propagate from the luminaire through the reflector area to the exterior. Alternatively, the polymer strip could be embodied as an adhesive coating/foil on the reflector. These embodiments are suitable as a wall washer luminaire, which also gives some subtle illumination of the luminaire itself and upwards to a ceiling (not shown). The light source 17 in this embodiment is a plurality of arrays of LEDs mounted on a rod-shaped carrier 37. Electrical contacting of the LEDs occurs via pins 39 that have to match with contacts in an end cap (not shown) to be provided in an opening 41 of the housing 3, the opening being in angled position with respect to the axis 7, i.e. transverse thereto.

Figure 4:
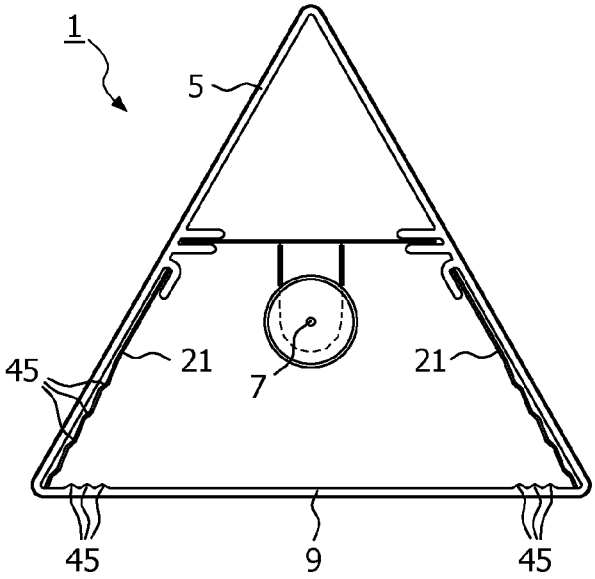
FIG. 4 is a cross section of a fourth embodiment of the luminaire of the invention.

In FIG. 4, a cross section of a fourth embodiment of a tubular injection molded polyethylene housing 3 of luminaire 1 with an annular triangular-shaped wall 5 is shown. A part of the two reflectors 21 and parts of the light emission window 9 have a Fresnel-like rippled profile 45 which, due to the extrusion process used to manufacture the housing, extend along the luminaire axis 7, causing the luminaire to have a desired beam pattern obtained in a relatively easy way. Alternatively such a profile in the light emission window is obtainable via an optic foil which is provided with a Fresnel lens structure, which foil is provided inside the housing at the light emission window.

Figure 5:
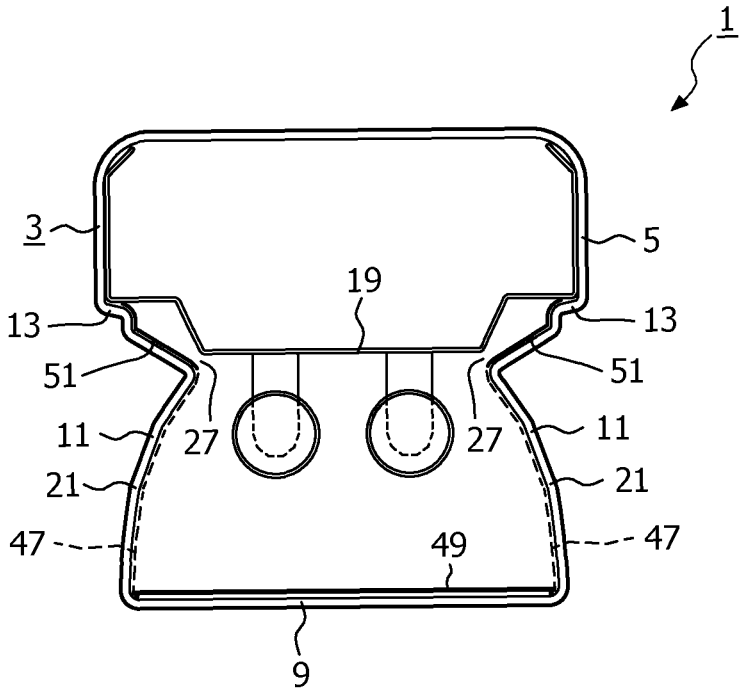
FIG. 5 is a cross section of a fifth embodiment of the luminaire of the invention.

FIG. 5 shows a cross section of a fifth embodiment of the luminaire 1 of the invention. The reflector area 11 is formed by two reflectors 21 which are in one piece with the extruded transparent PPMA housing 3, thus forming part of its square-like shaped annular wall 5. The reflectors each have a curvature according to a branch of a parabola and are provided with a specularly reflective spray coating 47 of chromium. The light emission window 9 is provided with a UV-absorbing optic foil 49. Two optic openings 27 are present between the reflector area 11 and the gear tray 19, enabling light to pass through said openings and subsequently through the wall to the exterior and hence provide indirect lighting during operation. To obtain a subtle illumination of the ceiling (not shown) from which the luminaire is suspended, a relatively thin, diffusely reflective, white coating 51, for example sprayed BaSO4 or Al2O3 having a transmission of only a few percent, is provided on the annular wall in between the electrical contact supports 13 and the respective reflector area.

Figure 6:
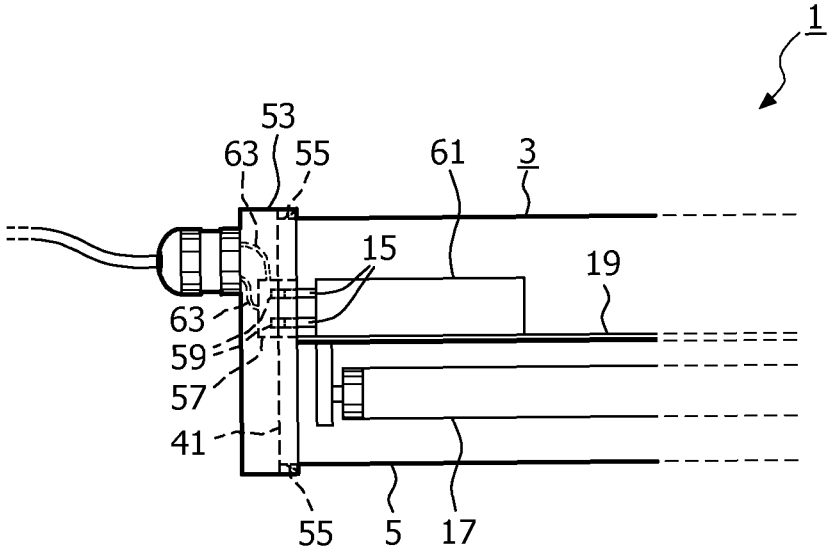
FIG. 6 shows a side view of a part of a sixth embodiment of the luminaire of the invention.

In FIG. 6, a part of a sixth embodiment of a luminaire 1 according to the invention is shown in a side view in which the reflectors are left out for the sake of clarity. The housing 3 of the luminaire is closed at its open end 41 in a dustproof/waterproof/explosion proof manner by means of a first end part 53 which, for this purpose, is provided with a rubber flange 55 that is supported against the wall 5 of the housing while exerting a resilient pressure thereon. The end part further is provided with a contact plug 57 having receiving openings 59 for receiving the electrical contacts 15 (for example pins 39 as shown in FIG. 3) that are provided on the gear tray 19, said gear tray further carrying an electronic circuit/ballast 61 for ignition and control of operation of the light source 17, in the Figure a fluorescent tube. The contact plug is electrically connected to the exterior via electrical cables 63 which are led through the end part in a gastight manner.

Hereinabove, a description has been given of embodiments of the luminaire according to the invention as described in the claims. These should be seen as merely non-limiting examples. As will be understood by a skilled person, many modifications and alternative embodiments are possible within the scope of the invention. It is to be noted that, for purposes of this application, and in particular with regard to the appended claims, the word "comprising" does not exclude other elements or steps, the word "a" or "an" does not exclude a plurality, which will be apparent to a person skilled in the art.

The invention claimed is:

1. A luminaire having a luminaire axis and comprising:

a one-piece, transparent, tubular housing with an annular wall around the luminaire axis, said housing comprising:

a light emission window extending along the luminaire axis, a reflector area adjacent the light emission window, at least one electrical contacting support provided as a profiled structure part of an inner side of the annular wall inside the housing and remote from the light emission window, two open ends in angled position with respect to the luminaire axis;

electrical contacts for accommodating at least one electrical lamp, said electrical contacts being removably held by the at least one electrical contacting support;

a first and a second end part, each end part being provided at a respective open end and at least the first end part being electrically connected to an electrical contact; and at least one reflector provided in the reflector area, wherein the at least one reflector is integrated with the housing.

2. A luminaire as claimed in claim 1, wherein the housing further comprises at least one reflector support.

3. A luminaire as claimed in claim 2, wherein the at least one reflector is held in between a respective reflector support and a respective further reflector support neighboring the at least one electrical contacting support.

4. A luminaire as claimed in claim 2, further comprising an opening defined between the at least one electrical contacting support and the reflector and/or a respective further reflector support.

5. A luminaire as claimed in claim 1, wherein the at least one reflector comprises a reflective coating in the reflector area.

6. A luminaire as claimed in claim 5, wherein the reflective coating is an adhesive, semi-translucent, white polymer strip or a separate, slidable semi-translucent, white polymer strip.

7. A luminaire as claimed in claim 1, wherein the housing has a cross section, which cross section at the location of the reflector area is shaped like a branch of an arc of a parabola, a branch of an arc of an ellipsoid or a part of a circle or like a part of a profile of a complex-shape reflector.

8. A luminaire as claimed in claim 1, wherein the reflectors and/or the light emission window have a rippled profile extending along the luminaire axis.

9. A luminaire as claimed in claim 1, wherein the light emission window is provided with an optic foil.

10. A luminaire as claimed in claim 9, wherein the optic foil has at least one of the features chosen from the group consisting of a lens structure, a color, a diffusion/reflection pattern, a UV-filter.

11. A luminaire as claimed in claim 1, further comprising a louver comprising at least two reflectors connected to each other via cross lamellae haying an outer edge adjacent the light emission window.

* * * * *